US009156666B2

(12) United States Patent
Romigh

(10) Patent No.: US 9,156,666 B2
(45) Date of Patent: Oct. 13, 2015

(54) CARRIAGE FRAME AND FORK PIN LOCK ASSEMBLY

(75) Inventor: Darian Ray Romigh, Massillon, OH (US)

(73) Assignee: JLG INDUSTRIES, INC., Hagerstown, MD (US)

( * ) Notice: Subject to any disclaimer, the term of this patent is extended or adjusted under 35 U.S.C. 154(b) by 1047 days.

(21) Appl. No.: 13/206,062

(22) Filed: Aug. 9, 2011

(65) Prior Publication Data

US 2013/0037348 A1 Feb. 14, 2013

(51) Int. Cl.

| | |
|---|---|
| ***B66F 9/18*** | (2006.01) |
| ***B66F 9/12*** | (2006.01) |
| ***B66F 9/14*** | (2006.01) |
| ***B66F 11/04*** | (2006.01) |

(52) U.S. Cl.

CPC ..... *B66F 9/127* (2013.01); *B66F 9/125* (2013.01); *B66F 9/142* (2013.01); *B66F 11/046* (2013.01); *Y10T 29/49947* (2015.01); *Y10T 403/7075* (2015.01)

(58) Field of Classification Search

CPC ..... B66F 9/075
USPC ..... 414/607, 814, 912
See application file for complete search history.

(56) References Cited

U.S. PATENT DOCUMENTS

| | | | | |
|---|---|---|---|---|
| 3,589,541 | A | 6/1971 | Melin | |
| 4,024,973 | A | 5/1977 | Siderits et al. | |
| 4,497,607 | A * | 2/1985 | Johannson | 414/664 |
| 5,230,600 | A | 7/1993 | Marino | |
| 7,146,004 | B2 * | 12/2006 | Bodley et al. | 379/430 |
| 2004/0197178 | A1 * | 10/2004 | Osterloh et al. | 414/607 |

* cited by examiner

*Primary Examiner* — Saul Rodriguez
*Assistant Examiner* — Willie Berry, Jr.
(74) *Attorney, Agent, or Firm* — Nixon & Vanderhye P.C.

(57) ABSTRACT

A carriage frame includes first and second side members supporting a floating fork pin, where the floating fork pin is movably mounted in respective fork pin slots in the first and second side members and is adapted to receive load carrying forks. The first and second side members each includes a locking aperture positioned spaced from the fork pin slots. A pair of lock plates are secured to ends of the floating fork pin, respectively, where each of the lock plates includes a lock pin slot and a lock pin hole positioned in substantial alignment with the locking apertures in the first and second side members. A pair of fork pin locks extend through the locking apertures of the first and second side members and are selectively extended through one of the lock pin slot and the lock pin hole. With the fork pin locks extending through the lock pin slots, the floating fork pin is movable in the fork pin slot, and with the fork pin locks extending through the lock pin holes, the floating fork pin is prevented from moving in the fork pin slot.

11 Claims, 3 Drawing Sheets

CARRIAGE FRAME AND FORK PIN LOCK ASSEMBLY

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a carriage frame for an industrial vehicle including load carrying forks suitable for supporting a work platform and, more particularly, the invention relates to a carriage frame and fork pin lock assembly for locking a floating fork pin on a carriage supporting a work platform.

Industrial vehicles such as telescopic material handlers (telehandlers) are known for lifting and carrying loads using load carrying forks. A load of goods may be supported on a pallet, which includes a supporting floor that is spaced from a bottom wall so that load carrying forks can be inserted between the bottom wall and the supporting panel to lift the pallet and the goods thereon. Telehandlers include a boom arm that enables the telehandlers to manipulate the load. It has been known to expand the functionality of a telehandler into use as a personnel work platform by using the load carrying forks to support a work platform.

In a typical construction, the load carrying forks are secured to a floating fork pin movably mounted in a carriage. The carriage or carriage frame includes side members that support the floating fork pin and respective fork pin slots. The fork pin is configured to float to compensate for uneven terrain while placing loads. When the construction is used to support a work platform, however, as occupants move from one end of the platform to the other, the platform may be subject to undesirable tipping.

BRIEF SUMMARY OF THE INVENTION

It would thus be advantageous to provide an assembly that would prevent such tipping when the industrial vehicle is being used as a personnel work platform while enabling the fork pin to float during use as a conventional telehandler. A fork pin lock assembly is cooperable with the carriage frame to selectively allow or prevent vertical travel (i.e., float) of the fork pin.

In an exemplary embodiment, a carriage frame includes first and second side members supporting a floating fork pin, where the floating fork pin is movably mounted in respective fork pin slots in the first and second side members and is adapted to receive load carrying forks. The first and second side members each includes a locking aperture positioned spaced from the fork pin slots. A pair of lock plates are secured to ends of the floating fork pin, respectively, where each of the lock plates includes a lock pin slot and a lock pin hole positioned in substantial alignment with the locking apertures in the first and second side members. A pair of fork pin locks extend through the locking apertures of the first and second side members and are selectively extended through one of the lock pin slot and the lock pin hole. With the fork pin locks extending through the lock pin slots, the floating fork pin is movable in the fork pin slot, and with the fork pin locks extending through the lock pin holes, the floating fork pin is prevented from moving in the fork pin slot.

Each of the fork pin locks may include a lanyard secured at one end to a respective one of the lock plates, and a lock pin secured at an opposite end of the lanyard. The lock pin is extendable through a respective one of the locking apertures and through a respective one of the lock pin slots and the lock pin holes. The fork pin locks may additional include a lynch pin extendable through the lock pin and/or a wire rope clamp secured to the lanyard.

The pair of lock plates may be secured to the ends of the floating fork pin on an inside of the first and second side members, respectively.

The carriage frame may additionally be provided with load carrying forks secured to the floating fork pin and a work platform supported on the load carrying forks, where with the work platform supported on the load carrying forks, the fork pin locks are extended through the lock pin holes of the lock plates.

The locking apertures in the first and second side members may be positioned about mid-way between a top and a bottom of the first and second side members. Additionally, the locking apertures in the first and second side members may be positioned about mid-way between a front and a back of the first and second side members In another exemplary embodiment, a fork pin lock assembly is cooperable with a floating fork pin in a carriage frame. The fork pin lock assembly includes a pair of lock plates securable to ends of the floating fork pin, respectively, where each of the lock plates includes a lock pin slot and a lock pin hole, and a pair of fork pin locks one each respectively extendable through the carriage frame and selectively extending through one of the lock pin slot and the lock pin hole. With the fork pin locks extending through the lock pin slots, the floating fork pin is in a movable position, and with the fork pin locks extending through the lock pin holes, the floating fork pin is in a locked position.

In yet another exemplary embodiment, a method of assembling a carriage frame including a floating fork pin for supporting a work platform includes the steps of mounting the floating fork pin in fork pin slots provided in first and second side members of the carriage frame; forming a locking aperture through each of the first and second side members, the locking apertures being spaced from the fork pin slots; securing a pair of lock plates to ends of the floating fork pin, respectively, each of the lock plates including a lock pin slot and a lock pin hole positioned in substantial alignment with the locking apertures in the first and second side members; and extending a pair of fork pin locks one each through the locking apertures of the first and second side members, and selectively extending the fork pin locks through respective ones of the lock pin slot and the lock pin hole, wherein with the fork pin locks extending through the lock pin slots, the floating fork pin is movable in the fork pin slot, and wherein with the fork pin locks extending through the lock pin holes, the floating fork pin is prevented from moving in the fork pin slot.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
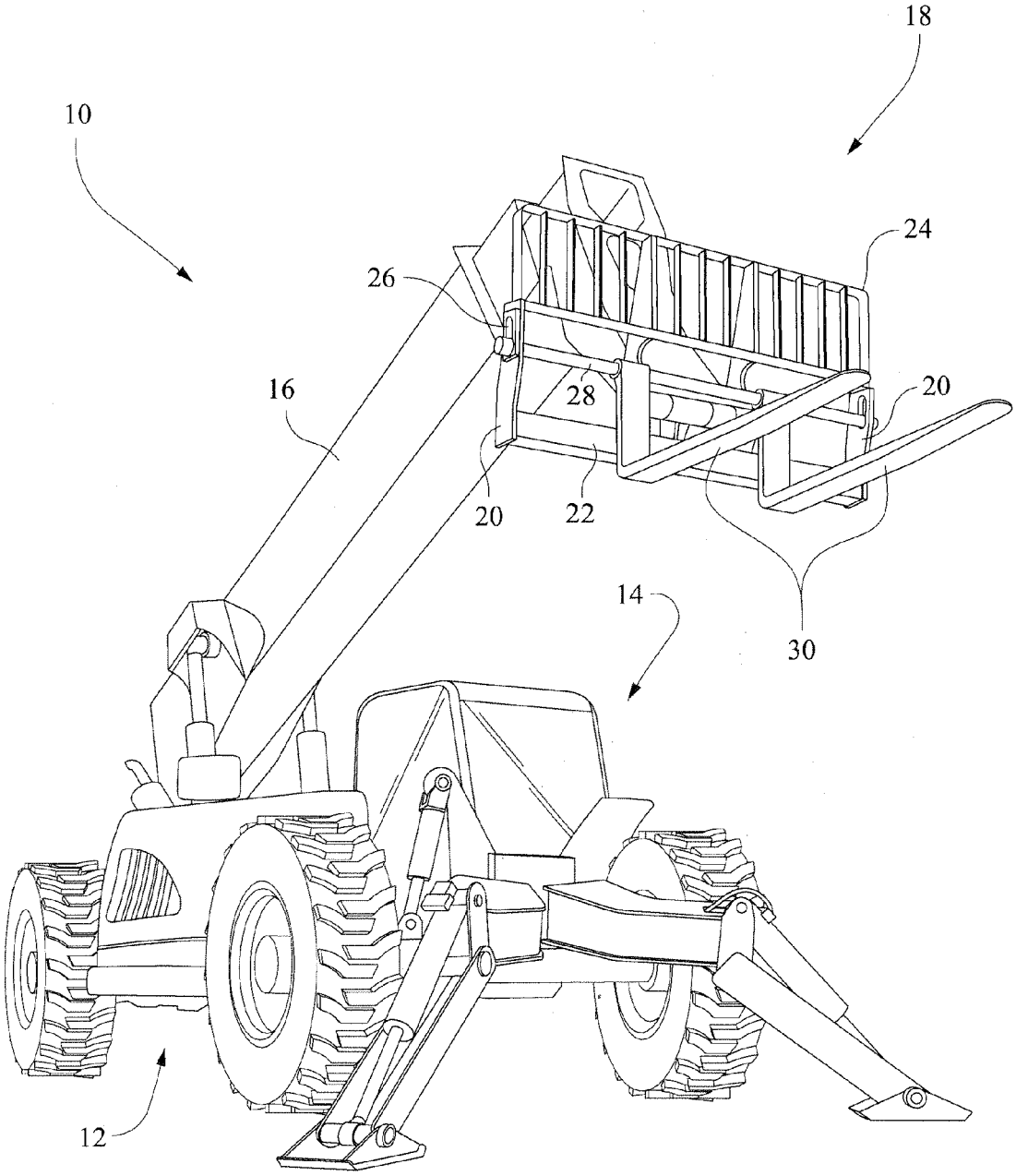
FIG. 1 is a perspective view of a telescopic material handler (telehandler) including a fork attachment.

FIG. 1 shows an exemplary telehandler 10 including a vehicle chassis 12, an operator cab 14, and a telescoping boom 16. Details of the structure and operation of the telehandler 10 are known and will not be further described.

The boom 16 supports a carriage frame 18 at a distal end thereof. The carriage frame 18 may be of any suitable construction and includes side members 20, a bottom member 22 and an upper structural framework 24. Each of the side members 20 includes a fork pin slot 26 that movably receives a floating fork pin 28. A pair of load carrying forks 30 are connected to the floating fork pin 28.

In use, the telehandler 10 is effective for lifting and manipulating loads by selective positioning of the telescopic boom 16. A typical example for use of a telehandler is to lift a pallet of construction materials such as lumber or the like to an upper floor in a construction site.

It has been known to use a telehandler as a personnel lift by supporting a personnel work platform on the forklift attachment of the carriage frame 18. With such an attachment, the telehandler can be used to raise and lower personnel standing on the work platform. Since the floating fork pin 28 supporting the load carrying forks 30 is movable in the fork pin slots 26, a problem has arisen in supporting a personnel work platform, however, in that the platform may be subject to tipping when personnel on the platform move from one end to the other. The invention relates to a fork pin lock device that can selectively prevent such tipping when a personnel work platform is supported on the carriage frame 18.

Figure 2:
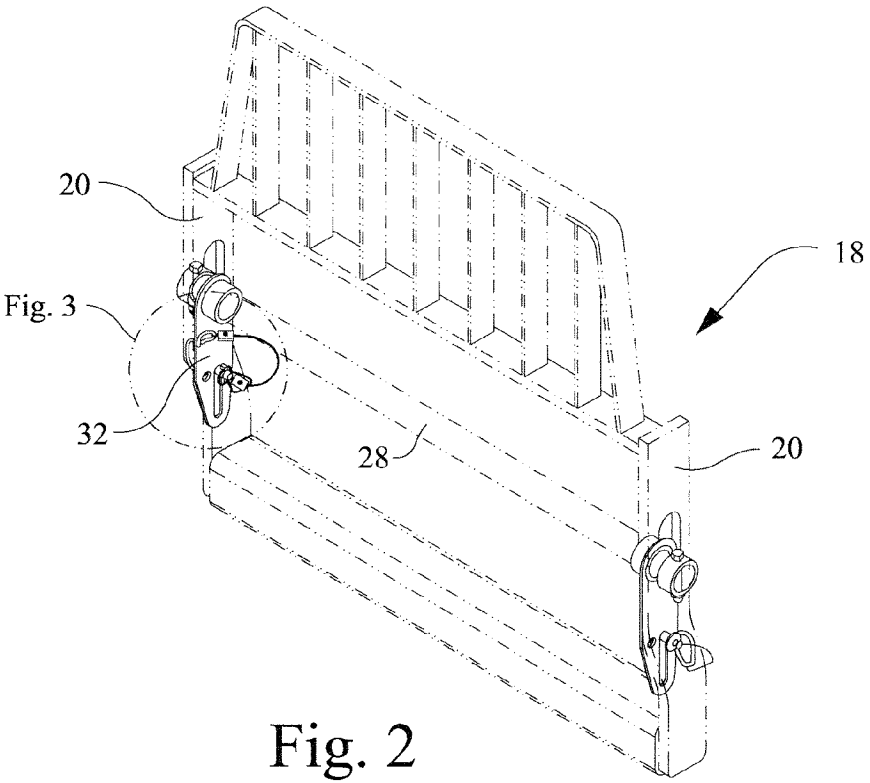
FIG. 2 is a perspective view of the carriage frame including the fork pin lock device.
Figure 3:
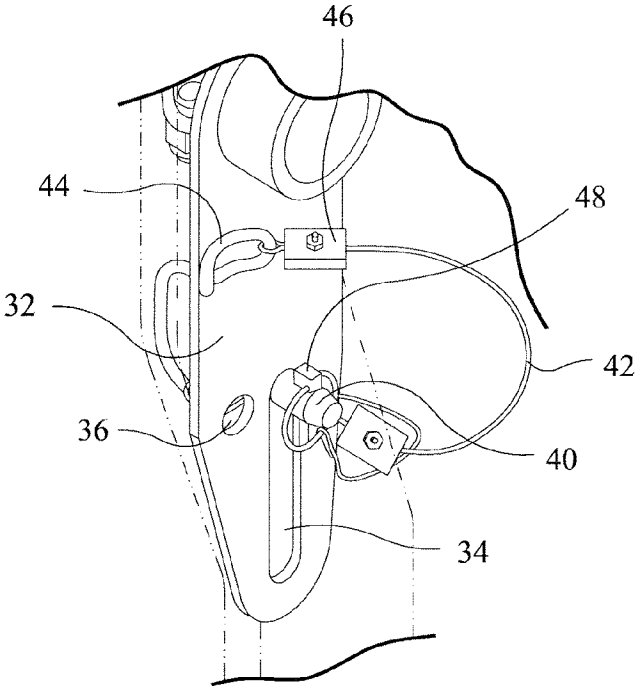
FIG. 3 is a close-up view of the fork pin lock device.

With reference to FIGS. 2 and 3, the fork pin lock device includes an assembly secured at each end of the floating fork pin 28. The assemblies are identical, and only one exemplary assembly will be described.

Figure 4:
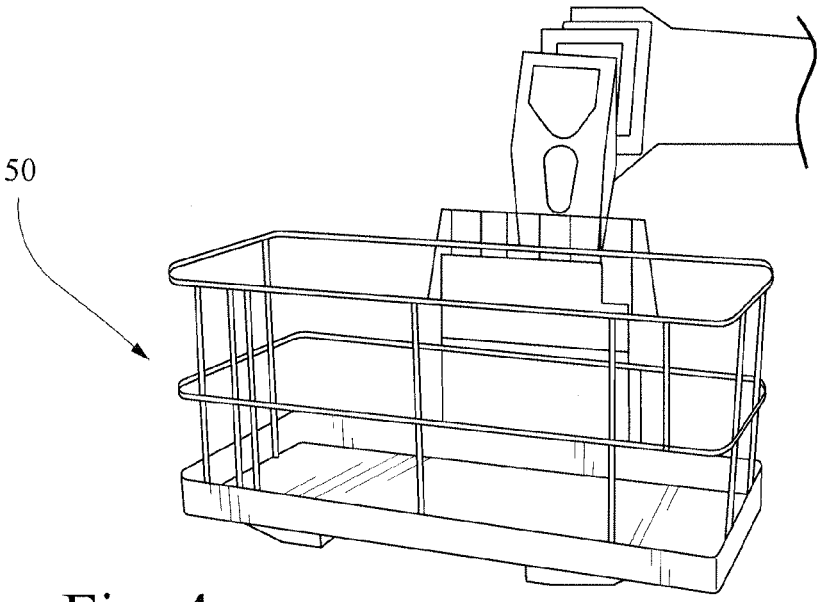
FIG. 4 shows a fork lift supporting a platform.

Each fork pin lock assembly includes a lock plate 32 secured at respective ends of the floating fork pin 28. The lock plate includes a lock pin slot 34 and a lock pin hole 36. As shown in FIG. 4, a locking aperture 38 is formed through each of the first and second side members 20. The lock pin slot 34 and the lock pin hole 36 are positioned in substantial alignment with the locking apertures 38.

A fork pin lock 40 is extendible through the locking aperture 38 and is selectively extendible through either one of the lock pin slot 34 and the lock hole 36. With the fork pin locks 40 extending through the lock pin slots 34, the floating fork pin 28 is movable in the fork pin slots 26. With the fork pin locks 40 extending through the lock pin holes 36, the floating fork pin 28 is prevented from moving in the fork pin slots 26.

The fork pin lock device may additionally include a lanyard 42 secured at one end to one of the lock plates 32, via a ring 44 or the like. Additionally, each of the fork pin lock devices may include a wire rope clamp 46 secured to the lanyard 42. The wire rope clamp 46 serves to secure the lanyard 42 to the ring 44 or other attachment.

With a work platform 50 supported on the load carrying forks 30 (see FIG. 4), the lock pins 40 are extended through the locking apertures 38 in the side members 20 and through the lock pin holes 36 of the lock plates 32. In this manner, as discussed above, the floating fork pin 28 is prevented from moving in the fork pin slots 26, thereby providing a stable support for the work platform 50.

Figure 5:
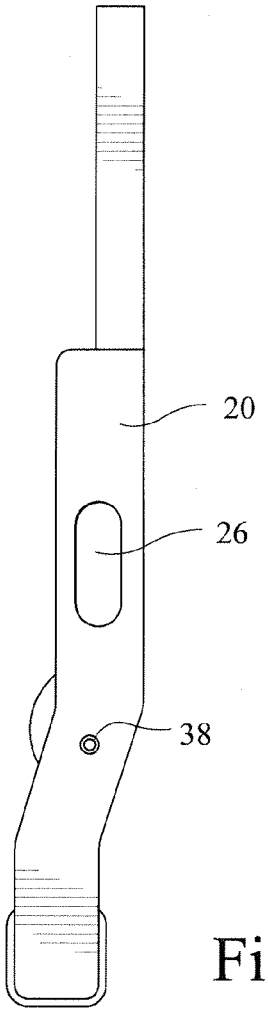
FIG. 5 is a side view of the carriage frame showing a preferred location for installing the fork pin lock device.

In one preferred construction, with reference to FIG. 5, the locking apertures 38 in the first and second side members 20 are positioned about mid-way between the top and bottom of the first and second side members 20. In the exemplary embodiment shown, the locking apertures are positioned about 19.75 inches from a top of the first and second side members 20. The locking apertures 38 are also preferably centered in the side members 20, and in the exemplary embodiment shown, the locking apertures 38 are about 2.8 inches from a side of the side members 20. Since only the locking apertures 38 need to be added to the side members 20 to accommodate the fork pin lock assembly, the fork pin lock assembly of the invention can be added as a field installation to existing machines The fork pin lock assembly could thus be provided as a kit for field installation. In this context, the fork pin lock assembly is provided with the pair of lock plates 32 and the pair of fork pin locks 40. The assembly may also include the lanyards 42 and the wire rope clamps 46. The lock pin may also include a lynch pin 48 to prevent the lock pin 40 from "backing out" of the hole 36 or slot 34. The lynch pin is preferably secured to the lock pin 40 using nylon coated steel cable.

The fork pin lock assembly of the described embodiments provides for a secure attachment of a personnel work platform to the lifting forks of a telehandler. The lock assembly may also be suitable for other attachments to the carriage frame where it is desirable to restrict the movement of the floating fork pin 28 in the fork pin slots 26.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A carriage frame comprising:

first and second side members supporting a floating fork pin, the floating fork pin being movably mounted in respective fork pin slots in the first and second side members and being adapted to receive load carrying forks, wherein the first and second side members each includes a locking aperture positioned spaced from the fork pin slots, and wherein the fork pin slots extend along a lengthwise direction of the first and second side members, respectively;

a pair of lock plates secured to ends of the floating fork pin, respectively, each of the lock plates including a lock pin slot and a lock pin hole positioned in substantial alignment with the locking apertures in the first and second side members; and a pair of fork pin locks one each respectively extending through the locking apertures of the first and second side members and selectively extending through one of the lock pin slot and the lock pin hole, wherein with the fork pin locks extending through the lock pin slots, the floating fork pin is movable in the fork pin slot, and wherein with the fork pin locks extending through the lock pin holes, the floating fork pin is prevented from moving in the fork pin slot.

2. A carriage frame according to claim 1, wherein each of the fork pin locks comprises:

a lanyard secured at one end to a respective one of the lock plates; and a lock pin secured at an opposite end of the lanyard, wherein the lock pin is extendable through a respective one of the locking apertures and through a respective one of the lock pin slots and the lock pin holes.

3. A carriage frame according to claim 2, wherein each of the fork pin locks further comprises a lynch pin extendable through the lock pin.

4. A carriage frame according to claim 2, wherein each of the fork pin locks further comprises a wire rope clamp secured to the lanyard.

5. A carriage frame according to claim 1, wherein the pair of lock plates are secured to the ends of the floating fork pin on an inside of the first and second side members, respectively.

6. A carriage frame according to claim 1, wherein the locking apertures in the first and second side members are positioned about mid-way between a top and a bottom of the first and second side members.

7. A carriage frame comprising:

first and second side members supporting a floating fork pin, the floating fork pin being movably mounted in respective fork pin slots in the first and second side members and being adapted to receive load carrying forks, wherein the first and second side members each includes a locking aperture positioned spaced from the fork pin slots;

a pair of lock plates secured to ends of the floating fork pin, respectively, each of the lock plates including a lock pin slot and a lock pin hole positioned in substantial alignment with the locking apertures in the first and second side members;

a pair of fork pin locks one each respectively extending through the locking apertures of the first and second side members and selectively extending through one of the lock pin slot and the lock pin hole, wherein with the fork pin locks extending through the lock pin slots, the floating fork pin is movable in the fork pin slot, and wherein with the fork pin locks extending through the lock pin holes, the floating fork pin is prevented from moving in the fork pin slot;

load carrying forks secured to the floating fork pin; and a work platform supported on the load carrying forks, wherein with the work platform supported on the load carrying forks, the fork pin locks are extended through the lock pin holes of the lock plates.

8. A fork pin lock assembly cooperable with a floating fork pin in a carriage frame, the fork pin lock assembly comprising:

a pair of lock plates securable to ends of the floating fork pin, respectively, each of the lock plates including a lock pin slot and a lock pin hole; and a pair of fork pin locks one each respectively extendable through the carriage frame and selectively extending through one of the lock pin slot and the lock pin hole, wherein with the fork pin locks extending through the lock pin slots, the floating fork pin is in a movable position and the fork pin locks are displaceable in the lock pin slots relative to the lock plates, and wherein with the fork pin locks extending through the lock pin holes, the floating fork pin is in a locked position.

9. A fork pin lock assembly according to claim 8, further comprising:

a pair of lanyards one each secured at one end to a respective one of the lock plates; and a lock pin secured at an opposite end of each of the lanyards, wherein the lock pin is extendable through the carriage frame and through a respective one of the lock pin slots and the lock pin holes.

10. A fork pin lock assembly according to claim 9, further comprising a lynch pin extendable through the lock pin.

11. A fork pin lock assembly according to claim 9, further comprising a wire rope clamp secured to each of the lanyards.

* * * * *